United States Patent [19]

Corlett

[11] 3,951,089

[45] Apr. 20, 1976

[54] ROLL-DAMPING TANKS FOR WATERBORNE VESSELS

[75] Inventor: Ewan Christian Brew Corlett, Basingstoke, England

[73] Assignee: Hydroconic Limited, England

[22] Filed: May 2, 1974

[21] Appl. No.: 466,460

[30] Foreign Application Priority Data

May 4, 1973 United Kingdom ..... 21406/73

[52] U.S. Cl. ..... 114/125

[51] Int. Cl.[2] ..... B63B 39/03

[58] Field of Search ..... 114/125; 61/4, 5, 6

[56] References Cited

UNITED STATES PATENTS

| | | | |
|---|---|---|---|
| 3,272,169 | 9/1966 | Ward | 114/125 |
| 3,282,239 | 11/1966 | Field et al. | 114/125 |
| 3,513,797 | 5/1970 | Frankel | 114/125 |

*Primary Examiner*—Trygve M. Blix
*Assistant Examiner*—Gregory W. O'Connor
*Attorney, Agent, or Firm*—Rose & Edell

[57] ABSTRACT

In a ship's roll damping tank, means are provided that are operative to extract substantial wave velocity energy from the liquid in the tank. Perforated pipes are laid in spaced parallel relationship across the bottom of the tank, i.e. in the fore and aft direction of the ship, to create, by injection from the pipes into the tank liquid, upflows of fluid that interfere with the normal orbital movement of the tank liquid wave particles.

Wave velocity energy can likewise be extracted by means of an apertured false bottom, upward protuberances on the tank floor, and perforated or unperforated horizontal end baffles.

7 Claims, 19 Drawing Figures

ROLL-DAMPING TANKS FOR WATERBORNE VESSELS

Figure 1:
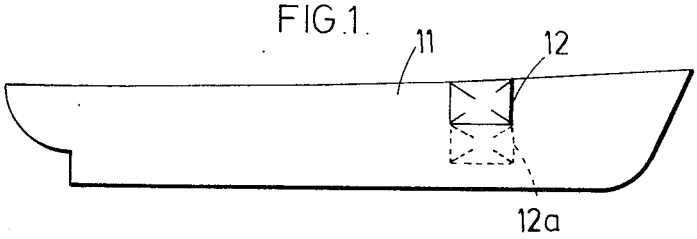

This invention relates to roll-damping tanks for waterborne vessels.

The open channel or free surface type of roll damping tank used for the reduction of roll response in waterborne vessels is well known and was first described by Sir Philip Watts in the 1870's. This type of tank depends upon a wave moving across the liquid in the tank in antiphase to the movement of the ship which carries the tank, the tank being tuned so that the natural period of the wave travelling backwards and forwards across the tank coincides with that of the ship but is 90° out of phase with it. tank increase In such a tank if the water is shallow fluid movement is by means of a shallow water wave or bore whose velocity is dependent on the depth of water in the tank. The bore, being a breaking wave, constitutes considerable internal damping. If the water is deeper a transitional wave is formed and when the water is deep enough no breaking occurs and water transfer is entirely by means of the normal wave velocity in the tank. This is relatively undamped and, although it may be arranged so that very efficient roll damping of the ship is produced at a particular frequency and a particular depth, subsidiary positons may be found where the roll is actually increased, generally at frequencies both lower and higher than the resonant frequency. It is desirable in the latter type of tak to inrease or provide the internal damping, namely the extraction of energy from the tank liquid, by internal means and, in the case of a tank with a bore, in some cases to increase the damping beyond that already provided by the bore.

Such a tank is generally of approximately rectangular cross section and viewed from above, fore and aft or athwartships the major axis is generally disposed transversely and extends the full breadth of the ship if this is possible.

According to the present invention, a ship's roll damping tank is provided with means, e.g. at the bottom or ends (port and starboard) of the tank, that are operative to modulate the wave energy of the liquid in the tank.

In one aspect there is disposed on or in or under the bottom of the tank a number of pipes, for injecting air or other fluid into the tank liquid, forming bands across the direction of movement of the water. These pipes may be external to the tank with suitable connections through the bottom structure of the tank if so desired, commoning the interior of the pipes with the tank water.

The pipes may be perforated suitably with small holes at small intervals along their length on the topside, or alternatively through the bottom of the tank, to form air injection points so that streams of bubbles may be injected into the tank in bands across the direction of motion of the water in way of each pipe by applying an air pressure to the pipe. The effect of such bubbles is to impart a local substantially vertical velocity to the water and this compounds with the velocity of the water across the ship along the major axis of the tank to produce an oblique flow. By suitable dispositon of the pipes and variatiion of the amount of air passing through them, and hence of the bubbles formed in the water, it is possible to alter significantly the orbital structure of the wave motion in the wave proceeding across the ship.

It is a feature of wave motion that it consists of orbital motions, the wave itself travelling but the particles of water oscillating about a fixed point. Where such a wave reaches shallow water the bottom of each orbit is braked and hence the orbit tends to depart from the circular condition, becoming elliptical with the major axis horizontal. It will be seen that if the vertical motion of the water particles is accelerated or braked, similar distortion of the orbit will take place and the bubble curtains produce this effect, causing first an alternation of the wave mean direction of flow and secondly, if the orbital alternation is great enough, a tendency for the wave to break, both effects producing internal damping.

Figure 3:
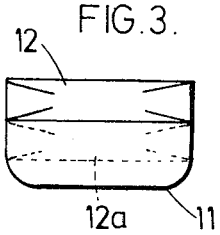
Figure 2:
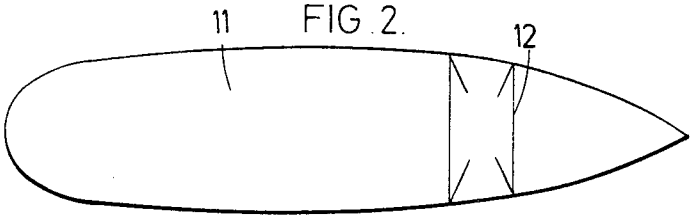
Figure 4:
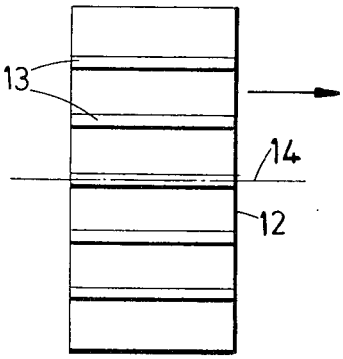
Figure 5:
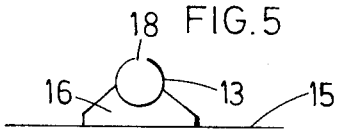
Figure 6:
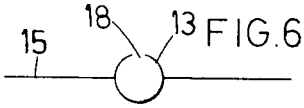
Figure 7:
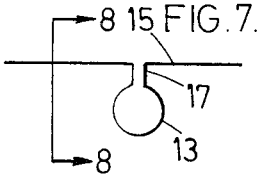
Figure 8:
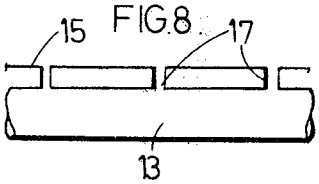
Figure 9:
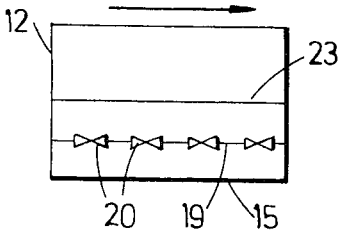
Figure 10:
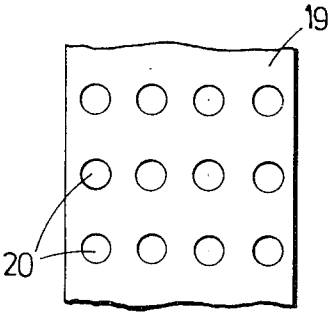
Figure 11:
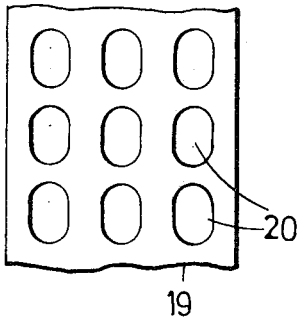
Figure 12:
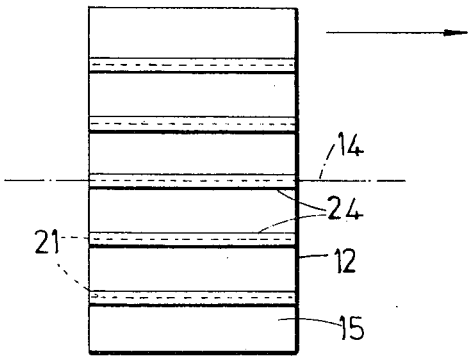
Figure 13:
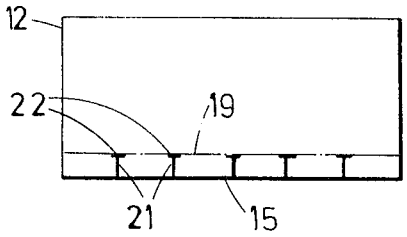
Figure 14:
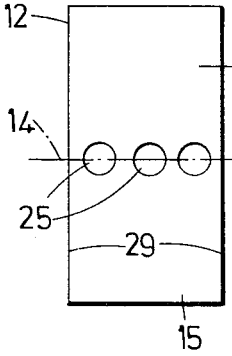
Figure 15:
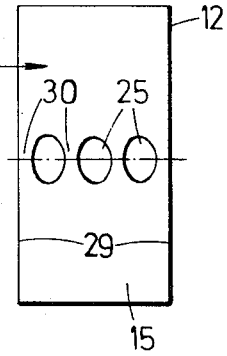
Figure 16:
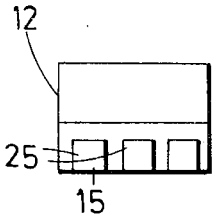
Figure 17:
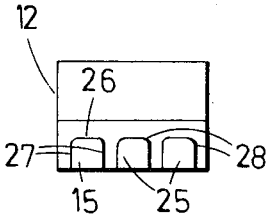
Figure 18:
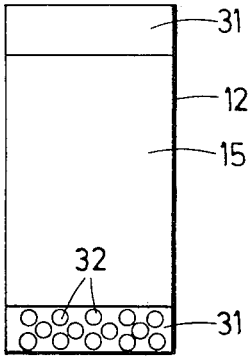
Figure 19:
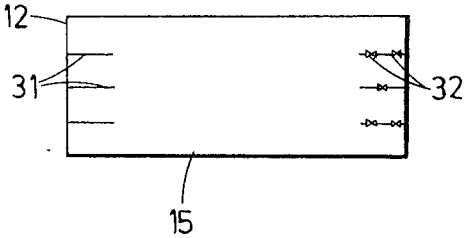

This and various other arrangements according to the invention will now be described by way of example and with reference to the accompanying diagrammatic drawings, in which:

FIGS. 1, 2 and 3 are, respctively, a side elevation, plan and cross section of a ship's hull fitted with a transversely-extending roll damping tank, FIG. 4 is a plan of one form of roll damping tank, FIGS. 5 to 7 show, seen in the fore and aft direction of the ship, various alternative pipe arrangements for the bottom of the tank of FIG. 4, FIG. 8 is a view of the arrangement of FIG. 7 in the direction of the arrows 8—8 of FIG. 7, FIG. 9 shows in cross section another form of tank, seen in the direction athwartships, FIGS. 10 and 11 are alternative arrangements of the tank of FIG. 9 seen in plan, FIGS. 12 and 13 show another tank arrangement in plan, and in cross section seen in the fore and aft direction of the ship, respectively, FIGS. 14 and 15 are two further arrangements of the tank bottom seen in plan, FIGS. 16 and 17 are, respectively, cross sectional views of the arrangements of FIGS. 14 and 15, seen in the directiion athwartships, and FIGS. 18 and 19 show yet a further tank arrangement in plan, and in cross section seen in the fore and aft direction of the ship, respectively.

Referring firstly to FIGS. 1 to 3, a ship's hull 11 is provided with a roll damping tank 12 extending the full breadth of the ship, which tank can be high in the hull as shown in full lines or at the alternative lower position shown in broken lines at 12*a*. FIG. 4 shows the tank in plan with air pipes 13 extending across the tank bottom in spaced parallel bands at right angles to the major axis of the tank, that is to say parallel to the fore-and-aft axis 14 of the ship. The pipes 13, each having a row of perforations 18 along its top, can be inside the tank supported just above the tank floor 15 by brackets 16, as shown in FIG. 5; or built into the tank floor as in FIG. 6; or below the tank floor with small bore tubes 17 leading from the perforations in the pipes to holes in the tank floor as shown in FIGS. 7 and 8.

It can be seen that by providing a large enough number of bands of air pipes 13 with, if desired, the possibility to vary the number actually used at a given time, and in all cases to vary the amount of air passing through what pipes are being used, the orbital motion of the wave in the roll damping tank 12 may be re-engineered to achieve the desired degree of internal damping. By this means, a ship stabilising moment expressed in terms of frequency can be produced which displays well damped characteristics, the resonant absorption of energy being lessened but more so the reflection of energy obtained at higher and lower frequencies than the resonant, as compared with the case where such damping is not employed. This is a desirable objective, rendering such roll-damping tanks usable over a wide range of ship frequencies and hence of conditions of loading and period of roll. The air pipes 13 may, of course, be used in association with other forms of internal liquid damping.

The fluid to be injected though the bottom bands of pipes may not be air but may be the liquid that is in the actual roll damping tank. For example, if water is the liquid in question a suitable pump drawing from the tank and discharging back to the tank through the perforated pipes may be used and, as this liquid will not travel very far beyond the orifices through which it enters the tank, it will affect only the lower sides of the orbits of the water particles in the tank waves travelling athwartships.

It can be seen that if an orbital particle is traversing the tank, say, from left to right at a velocity $V_1$ and it meets water which has been ejected from a hole in a fore and aft injection pipe travelling vertically with velocity $V_2$, there is a considerable loss of energy in the impact and the mixing because this forms a vortex of a turbulent nature. This vortex extracts energy from the system and in so doing reduces $V_1$. The net result is to extract energy from the bottom of the wave system and thus increase the tendency of the wave to break. This may be used in a roll damping tank where a transitional wave which is not breaking is present, to turn it into a breaking wave and thus further absorb energy by the bore effect. The water for such purpose may, in a preferred embodiment, be drawn from suitable suction points in the tank which may be similar sets of pipes and holes that, by the reverse effect to the one described earlier, also decrease the orbital velocity at the lower part of the orbit and hence tend to steepen the wave. The period of the wave and in consequence its energy remain substantially the same but the height increases, and it can be made to break, or alternatively it can by such means of control be caused to impinge upon suitable baffles, such as horizontal baffles at the end of the tank which would not otherwise be reached by the wave water. Thus by varying the amount of water in this particular embodiment of the invention, or the amount of air in the embodiment first described, the internal damping of the tank may be changed substantially and furthermore in a number of cases the invention enables the use of a substantially greater depth of water in a Watts shallow water bore type tank than would be possible without the artificially breaking wave induced by the invention.

In another arrangement, as shown in FIG. 9, a false bottom 19 is fitted in the tank 12 with rows of holes 20 disposed transversely in the tank, that is to say longitudinally in the ship, and if this bottom is at a suitable height above the true bottom 15, the water will be forced, by its orbital motion or by the vertical velocity of breaking in the case of the bore type tank, to pass through the holes 20 and thereby suffer energy loss due to the 'wire drawing' effect. The holes may be circular, as in FIG. 10, or elongated as in FIG. 11. Where such a permeable horizontal bottom is interposed in way of a wave, the general distortion and displacement compared with quiet water conditions under a wave of say trochoidal shape is such that there are vertical pumping actions through the permeable surface. This is equivalent, of course, to the permeable surface being interposed in way of the orbital motions of the wave particles.

The effect may be changed by adjusting the vertical height of the permeable bottom and this may, from experimental and theoretical considerations, be so arranged as to give a desired degree of damping.

The actual tank bottom 15 may have secured to it, as in FIGS. 12 and 13, members such as horizontally disposed 'T' bars 21 with their longitudinal axes across the short dimension of the tank, i.e. fore and aft in the ship, and spaced from each other so that there are gaps between their flanges. Thus, a series of horizontal slots 24 may be formed across the tank at any given height by having the T bar flanges 22 at that height; alternatively, these T bars or similar structural members can be used for attachment thereto of a false plate bottom 19 which may be perforated or slotted in such manner as may be found desirable in a particular case.

The effect of the interposition of such a surface, which may be at any height from the bottom up to the still level surface 23 (FIG. 9) of the water in the tank, is to shorten the distance between wave crests but to flatten them. This may be used to obtain a wave of translation which is in effect a standing wave, the wave crest at any point simply oscillating up and down. The arrangement may be used with any liquid although in a seagoing vessel sea water is an obvious choice. However, fresh water or various oils can be used as may be desired. The arrangement permits the attainment of a higher roll stabilising moment than is possible with a tank with bore type transfer of water from one side of the tank to the other. It also provides a considerable amount of damping which may be varied to obtain that which is desired and may be great enough to provide a true standing wave. The widths of the slots 24 between the T bars 21 can be arranged so that the necessary relationship between depth potential and velocity potential at any point is achieved in order to obtain a standing wave.

In another arrangement, shown in FIGS. 14 to 17, there are provided upstanding from the tank floor 15 near the centreline 14 of the ship a row of humps or bumps 25 which may be welded, bolted or otherwise attached to the bottom of the tank. These bumps may be circular in plan, as in FIG. 14, or elliptical, as in FIG. 15; in FIGS. 14 and 16 they are short cylinders but in another suitable form, shown in FIGS. 15 and 17, they are moulded in a shape like a flattened ellipsoid, the flat 26 at the top being parallel to the bottom of the tank, the plan view being elliptical, and the profiles of the cross sections being flat on top, vertical at 27 where the bump butts on the tank bottom 15 and with curved corners 28. The moulded plan profile can also be circular in which case the resultiing shape is rather like the cap of a mushroom.

Such humps or bumps 25 are generally arranged to be of a height substantially lower than the top level 23 of water in the tank so that the water may flow over them. In the case of the shallow water bore type tank it is desirable that each bump 25 should not be higher than the low level depth of the water, thus allowing the bore to pass unobstructed over the bump. However, the vertical dimension of the bump may be made greater, especially in the case of roll damping tanks which do not utilise a breaking bore, but generally they will not exceed the static level depth of the water. In a suitable form, these bumps 25 may be constructed as fibreglass mouldings with a lip or flange which can be bolted to the bottom 15 of the roll damping tank and which allows changing of each bump for one of a different height if the service of the vessel is radically altered.

Only a single bump could be employed but generally the bumps are two, three or more in number disposed in a row fore and aft along the centreline 14 of the vessel, the spaces between them, and between the end bumps of the row and the walls 29 of the roll damping tank, forming shallow venturis 30 whose central axes lie athwartships.

The action of the bumps is twofold. Firstly, in either type of tank the venturi effect of the apertures 30 between the bumps, and between the bumps and the tank bulk-heads or walls, produces an acceleration of flow and then a sudden deceleration inducing heavy turbulence and extracting energy from the water or other liquid. Secondly, the shape of the bumps transversely is such that there is a spilling action as the water goes over the downstream side of each bump but as the bump is circular or elliptical in plan view this spilling action is not uniform and solely in the transverse direction across the ship but is in places obliquely angled in both directions as well as spread transversely. The net result is the formation of a vortex which extracts a considerable amount of energy from the system and this may be used to supply internal damping to the liquid in the roll damping tank irrespective of its type.

A further arrangement, which may be used in association with the above or alternatively quite separately, and shown in FIGS. 18 and 19, consists of the fitting of horizontal plates or baffles 3 at the ends of the tank 12, that is to say port and starboard of the ship, parallel to the bottom 15 of the tank, and disposed at varying levels between the bottom of the tank and the top. These baffles 31 may be one or two in number, or there may be a considerable number dependent upon the detailed design of the individual tank. When the wave, whatever its nature, reaches the end of the tank it is reflected therefrom and generally produces an increase in level at the tank end in the process of reflection. This increase in level causes a vertical movement of the water at the ends of the tank and the object of the horizontal baffle plates 31, which may extend over either a small or a considerable transverse length of the tank, is to restrict this vertical flow and extract energy therefrom.

To this end in some circumstances it is possible to use solid baffles which may be below water level, in which case the liquid reaching the end of the tank is split into a number of discrete layers in each of which a heavy vortex arises and when the water flows back out of each compartment formed between consecutive baffles it generally does so with a waterfall effect which extracts by turbulence and vorticity a considerable amount of energy.

In another and preferred form, the horizontal baffles 31 are perforated, as shown at 32, and this allows water to penetrate each baffle upwards but in going through the perforations the water or other liquid loses energy through turbulence and the 'wire drawing' effect. The size of the holes 32 may be adjusted to suit the design of the tank and the degree of internal damping required. Generally, the holes will be fairly large, possibly of the order of 10% of the fore and aft dimension of the tank, but this does not preclude the use of larger or smaller holes in a particular design.

In a further form, the holes 32 in consecutive horizontal baffles at a tank end are relatively staggered; in other words, a hole in the lowest baffle faces directly on to solid plate of the next baffle up, the holes in the second baffle face solid plate in the third baffle, and so on. The holes in the third baffle may, of course, if desired line up with the holes in the first baffle. Thus, a tortuous path is introduced and further energy is lost by kinetic energy dissipation in forcing the water to adopt this tortuous path.

I claim:

1. A ship's roll-damping tank, provided with means at the bottom and ends, port and starboard of the tank, that are operative to modulate the wave velocity energy of the liquid in the tank, said means including at least one row of low spaced discrete protuberances upstanding from the tank floor gaps between said protuberances that extend down to the tank floor said row being parallel to and substantially at the fore and aft center line of the ship, said low protuberances being totally submerged under all conditions of operation.

2. A tank according to claim 1, wherein the protuberances are in the form of short upright cylinders.

3. A tank according to claim 1, wherein the protuberances have flat tops and vertical sides joined by rounded corners.

4. A tank according to claim 3, wherein the protuberances are elliptical in plan with the major axis of the ellipse extending arthwartships.

5. A tank according to claim 1 wherein said energy-modulating means further comprise, at each end of the tank (port and starboard) at least one horizontal baffle extending inward from the tank end wall at at least one height up the tank wall above the tank floor.

6. A tank according to claim 5 wherein said baffle is perforated with holes.

7. A tank according to claim 6, wherein there are a number of vertically spaced baffles at each end of the tank and the holes in consecutive baffles are relatively staggered.

* * * * *